United States Patent [19]

Agyagos

[11] 4,341,378

[45] Jul. 27, 1982

[54] MULTIPURPOSE EXERCISER DEVICE

[76] Inventor: Ferenc I. Agyagos, 3-21-5, Akasaka, Minato-ku, Tokyo, Japan

[21] Appl. No.: 189,330

[22] Filed: Sep. 22, 1980

[30] Foreign Application Priority Data

Sep. 25, 1979 [JP] Japan ..... 54-132362

[51] Int. Cl.[3] ..... A63B 1/02; A63B 23/02

[52] U.S. Cl. ..... 272/62; 272/144; D21/191

[58] Field of Search ..... 272/61-64, 272/93, 109-113, 144; D21/91, 235, 195

[56] References Cited

U.S. PATENT DOCUMENTS

| | | | |
|---|---|---|---|
| D. 216,721 | 3/1970 | Sassenberg | D21/191 |
| D. 221,447 | 8/1971 | Brubaker | D21/191 |
| D. 254,143 | 2/1980 | deBock | D21/195 |
| 2,222,119 | 11/1940 | Overholt | 272/113 X |
| 2,764,412 | 9/1956 | Dunham | 272/144 |
| 2,817,522 | 12/1957 | Margulies | 272/62 X |
| 3,006,643 | 10/1961 | Ryan | 272/144 |
| 3,119,613 | 1/1964 | Zbyszko | 272/144 |
| 3,378,259 | 4/1968 | Kupchinski | 272/144 |
| 3,521,881 | 7/1970 | Schgevitz | 272/62 X |
| 3,659,844 | 5/1972 | Cummins | 272/63 X |
| 3,709,487 | 1/1973 | Walker | 272/62 X |
| 3,782,717 | 1/1974 | Berlin | 272/144 |
| 3,857,561 | 12/1974 | Cecchettini et al. | 272/63 X |
| 3,891,207 | 6/1975 | Helliwell | 272/62 X |

FOREIGN PATENT DOCUMENTS

| | | | |
|---|---|---|---|
| 319819 | 7/1934 | Italy | 272/63 |

*Primary Examiner*—Richard J. Johnson

*Attorney, Agent, or Firm*—Stevens, Davis, Miller & Mosher

[57] ABSTRACT

A compound multipurpose exerciser device which is a device having a substantially horizontal exercising cot of the folding frame type positioned in a support base having an inverted U-shaped hanger frame member positioned horizontally above the exercising cot.

5 Claims, 3 Drawing Figures

MULTIPURPOSE EXERCISER DEVICE

BACKGROUND OF THE INVENTION

This invention relates to a compound multipurpose exerciser device embodying a substantially horizontal exercising cot of the folding frame type which is joined to a U-shaped hanger stretching frame.

Many types of exercising devices are known in the art for allowing a user to exercise parts of the body by body manipulation, with many devices needed for different portions of the body.

SUMMARY OF THE INVENTION

The present invention contemplates an exerciser device having multipurpose features, which device is of simple construction and is foldable when not in use. The exerciser device covers a foldable exercising cot having a body supporting frame which is adapted to support the human body in a reclined position and enable the performance of bending exercises of the waist, side, and hip regions; and a base frame member supporting a pair of vertically extending legs or bars adapted to receive a horizontal hanger frame member for the performance of spine stretching and chin-up exercises when desired.

In Japanese Utility Model No. 50-34133, and exercising cot of the type mentioned above exists to be used for the purpose of waist, side and hip region exercises; however, this prior type is not a compound exercising apparatus but merely acts as a single functioning device.

The spine stretching bars of the prior types have been restricted to single purpose use without being used as a constituent part of a compound device. In addition, their construction has been rather awkward and time consuming as far as their assembly and disassembly are concerned.

Accordingly, one object of the present invention is to provide a compound exerciser device for (a) enabling the performance of the waist, side and hip bending exercises, and (b) for the performance of the spine stretching and chin-up exercises, by utilizing only one device.

Another object is to provide a compound exerciser device which is easily maneuverable and so constructed as to enable one-touch adjustment from one mechanical application to the other.

Last but not least, another object is to provide a versatile folding compound exerciser device which is easily stored in a space-saving manner.

BRIEF DESCRIPTION OF THE DRAWINGS

The foregoing and other objects of this invention can be appreciated from the following description of a preferred embodiment and claims taken in conjunction with the drawings, in which:

DESCRIPTION OF A PREFERRED EMBODIMENT

Figure 1:
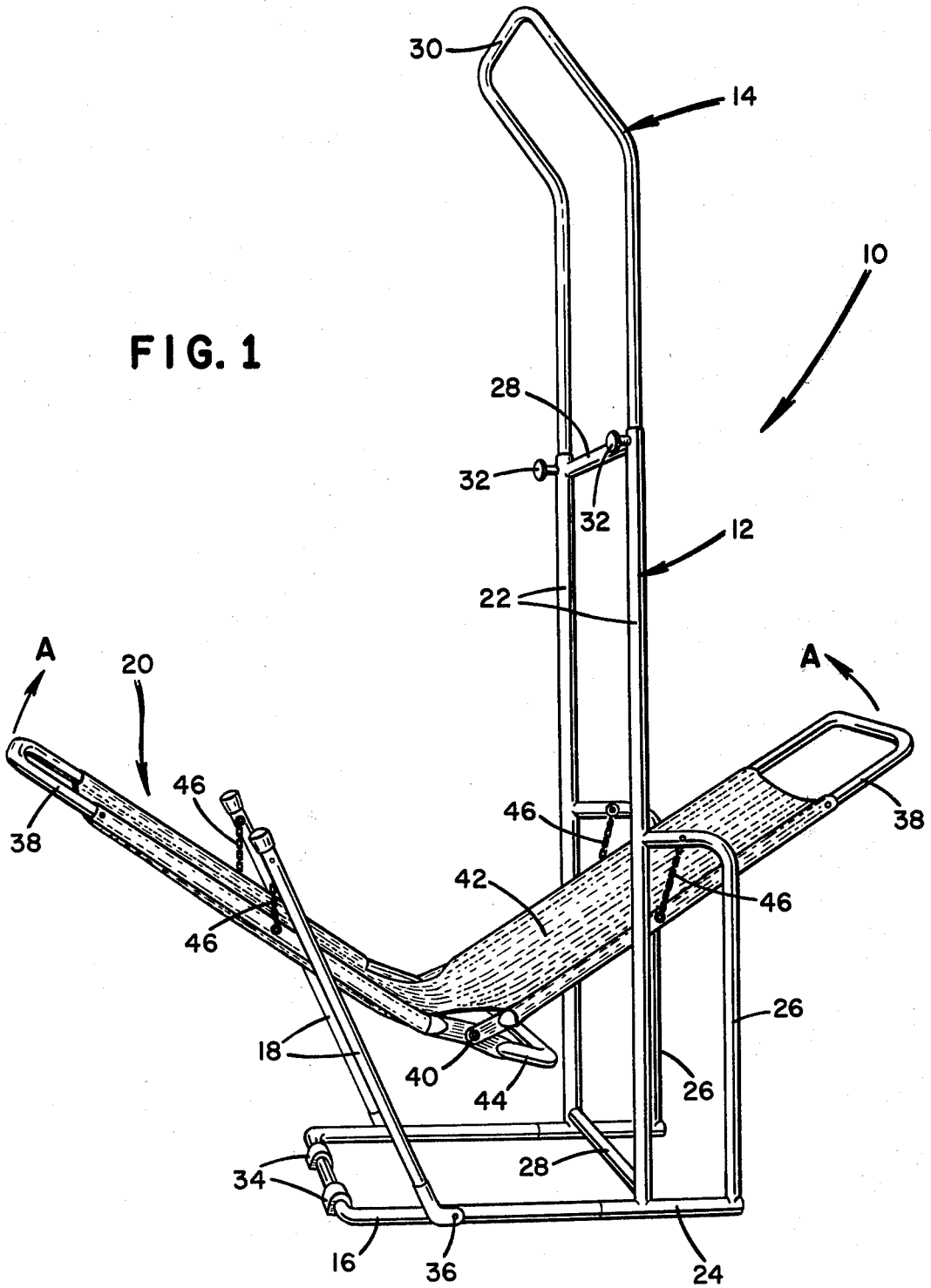
FIG. 1 is a vertical view in perspective of the compound exerciser device in unfolded position with an inverted U-shaped hanger frame member in extended position in accordance with the invention.
Figure 2:
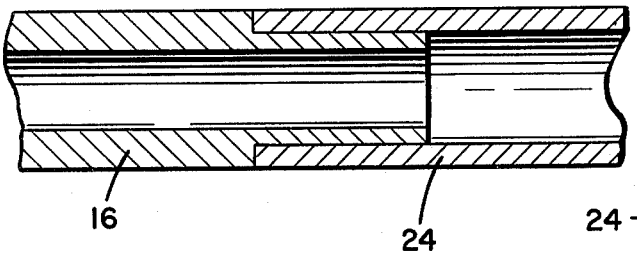
FIG. 2 is a partial cross-sectional view of a section of one of the connections between the ends of two individual base frame elements that form the base of the compound exerciser device.

FIG. 1 of the drawings illustrates a compound exerciser device 10 constructed in accordance with the invention having a support base frame member. The support base frame is formed from two U-shaped independent base frame elements 16 and 24. The free ends of the two independent base frame elements 16 and 24 are made to fit into each other to form the support base frame member (see FIG. 2).

Extending upward from the free ends of the base frame element 24 are a pair of spaced apart vertical legs or pipes 12,12 that support an inverted U-shaped hanger frame member 14. The inverted U-shaped hanger frame member or pipe 14 is tele-scopingly mounted in the top free ends of the vertical legs 12,12. The top portion of the U-shaped hanger frame member is a horizontal hand grip bar or pipe 30 which is so positioned in the member 14 as to enable a user to hang onto the frame to perform spine stretching and chin-up exercises. The hanger frame member 14 is held in an adjustable tight position with respect to each of the legs 12,12 by means of support knob or locking pin 32 which passes through the wall of pipe 12 and lockingly engages the pipe of the telescoping end section of the hanger frame member 14.

The horizontal hand grip 30 is slightly pitched inward towards the center of the device so as to maintain the apparatus in balance when a person is performing the spine stretching or the chin-up exercises (see FIG. 1). The horizontal hand grip 30 can be adjusted in accordance with the height of the person by telescopingly adjusting the height of the inverted U-shaped hanger frame member and by perforated holes on the end of the frame members 14,14 and 12,12 at predetermined points in which the locking pins 32 can be inserted to lock the hand grip 30 at the desired exercising height position.

The ends 22,22 of the spaced apart vertical legs 12,12 are connected by a pair of spaced horizontal strengthening elements 28,28, one at the lowermost portion of the legs where they are fastened to the base frame element 24 and the other at the top of the free ends of the legs 12. This support structure adds strength to the spine stretching or chin-up exercising portion of the multiple exerciser device.

In addition, this lower part of the base member forming a vertical rectangular frame is reinforced by another pair of support elements 26,26 which are attached and extend from the outermost portion of the base frame element 24,24 and then run vertically parallel to legs 12,12; and each has an angled end at its upper portion which is joined to a leg 12 at its uppermost end.

A pair of slip-proof rubber cleats 34,34 are placed at convenient points on the base frame member 16 which provide for frictional engagement between the base and the floor during use of the device while exercising.

A pair of pivoting legs 18,18 are pivotally joined at one end at points 36,36 to the U-shaped base frame element 16 and have upward and outward extending free ends. The legs 18,18 are positioned so as to form a convenient angle to act as free arms that can be moved to an open position and to a closed position when opening and closing the exerciser frame.

Positioned between the free end portions of legs 18,18 and the top portion of support elements 26,26 is a hinged frame assembly of an exercising cot 20. The exercising cot 20 is formed from two U-shaped frame halves 38,38 pivotally jointed together at their free end sections in pivot connections 40. A bracing bar 44 having angled portions extends across and below the pivot joint 40 of the frame halves and is pivotally joined thereto. A canvas covering 42 is disposed over the two frame halves and joined to all of the sides thereof, with the bracing bar 44 strengthening the frame while lying a distance therefrom so as to eliminate distortions across the canvas covering. Thus the two U-shaped frame halves 38,38 joined at points 40,40 form a rectangular frame, and the arms of the frame halves form the sides of the frame when the frame halves are oriented in a coplanar configuration, thus forming with the canvas cover 42 the exercising cot 20.

The exercising cot 20 is attached to the support base frame member by means of chains 46 or other suitable attaching means of effective strength and length, with one of their ends pivotally joined at convenient connecting points located on each of the opposite sides of the U-shaped frame halves 38,38, and the other ends of the chains projecting upwardly from one U-shaped frame half to suitably receptive points on the support elements 26,26 of the support base frame member, and upwardly from the other U-shaped frame half to the top portion of the free end of legs 18,18.

With the above connections, the exercising cot 20 can be opened and closed easily for storage between the vertically extending legs 12,12 and the vertical portions of support elements 26,26 simply by bringing together the opposite sides of the U-shaped frame halves 38,38 of the cot in the direction as shown by the arrows designated by the letter A in FIG. 1, to arrange the cot in a folded position.

Thus the compound exerciser device can be folded easily for storage when not in use. The inverted U-shaped hanger frame member 14 can be released easily from its position in the vertical legs 12,12 by loosening the knobs or locking pins 32,32.

Figure 3:
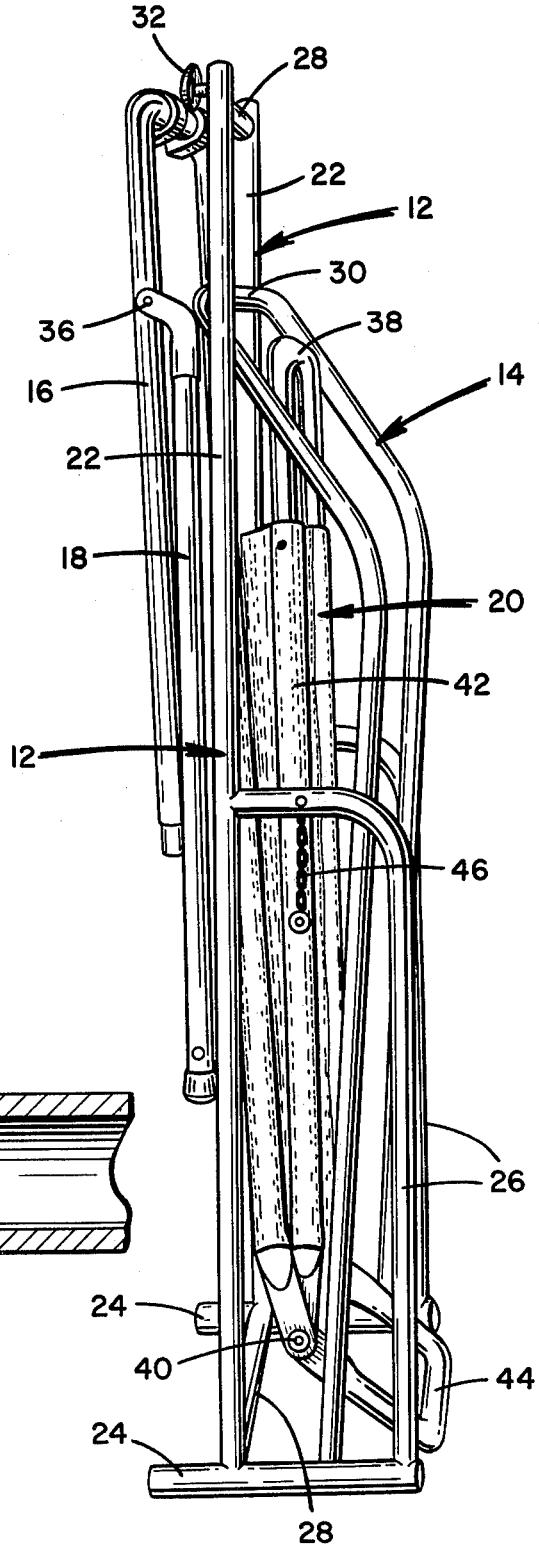
FIG. 3 is a vertical view in perspective of the compound exerciser device in a folded position with the inverted U-shaped hanger frame member in a retracted position.

Moreover, the free ends of U-shaped base frame element 16 is disconnected from the free ends of the second base elements or pipes 24,24 and placed in position with the latter in parallel by completely slanting the diagonal free arm movement legs 18,18 with respect to the former (see FIG. 3). Thus, by folding the cot as heretofore described, the exerciser device is placed into a compact position.

It should be understood that many variations and modifications of the device of this invention may be made and that the scope of the invention is limited only by a just interpretation of the appended claims.

What is claimed is:

1. A compound multipurpose exerciser device on which reclining waist, side and hip exercises can be performed, said exerciser device comprising a base frame member supporting a pair of vertically extending frame support elements at one end of said base frame, said base frame member having a pair of separate spaced-apart vertically extending legs that have attached thereto an inverted U-shaped hanger frame member, said frame support elements being attached to said legs at a substantially intermediate location thereof, said U-shaped hanger frame being positioned higher than said frame support element for use in the performing of spine-stretching and chin-up exercises, the upper end of the inverted U-shaped hanger frame member being bent slightly inwardly towards the other end of the base frame for improved stability; and including a substantially horizontal exercising cot which is operably supported by upwardly extending portions of said base frame member, said cot being formed from two U-shaped frame halves, the free end portions of which are pivotally connected together so that the frame halves can be folded, said frame halves having a bracing bar extending between the pivot connections of the two U-shaped frame halves.

2. The compound multipurpose exerciser device as defined in claim 1 in which the cot-forming frame halves are supported by a plurality of flexible support means pivotally attached to each side of said U-shaped frame half, and the other of said flexible support means being attached to said vertically extending legs and to support means which are attached to the upwardly extending portions of said base frame member.

3. The compound multipurpose exerciser device as defined in claim 2 in which said flexible support means is a link chain.

4. The compound multipurpose exerciser device as defined in claim 1 in which a pair of legs having free end portions are pivotally connected to said U-shaped base frame element with each free end thereof connected by said flexible support means to one of said cot-forming U-shaped frame halves.

5. The compound multipurpose exerciser device as defined in claim 4 in which said pair of legs connected pivotally to said U-shaped base element form an optimum angle with respect to said base and serve as a free arm movement in opening and closing the exercising cot from and into the storage position between said spaced-apart vertically extending legs.

* * * * *